US006604604B1

(12) United States Patent
Badeau et al.

(10) Patent No.: US 6,604,604 B1
(45) Date of Patent: Aug. 12, 2003

(54) CATALYTIC MUFFLER AND METHOD

(75) Inventors: Kurt M. A. Badeau, Evansville, WI (US); Kory J. Schuhmacher, Oregon, WI (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/665,809

(22) Filed: Sep. 20, 2000

(51) Int. Cl.[7] ..... F01N 1/24
(52) U.S. Cl. ..... 181/258; 181/230
(58) Field of Search ..... 181/240, 230, 181/264, 267, 268, 269, 272, 274, 275; 60/299, 302

(56) References Cited

U.S. PATENT DOCUMENTS

| | | | | |
|---|---|---|---|---|
| 1,671,829 A | | 5/1928 | Ledwinka | |
| 1,739,039 A | | 12/1929 | Powell | |
| 1,741,078 A | | 12/1929 | Scarritt | |
| 2,019,746 A | | 11/1935 | Tatter | |
| 2,071,351 A | | 2/1937 | McNamara | |
| 2,511,597 A | | 6/1950 | Marx | |
| 2,567,568 A | | 9/1951 | Lievense et al. | |
| 3,220,506 A | | 11/1965 | Vernet | |
| 3,670,845 A | * | 6/1972 | Betts | 181/57 |
| 4,094,645 A | | 6/1978 | Bailey | |
| 4,244,442 A | | 1/1981 | Scarton et al. | |
| 4,286,689 A | | 9/1981 | Malmsten | |
| 5,162,622 A | | 11/1992 | Malmsten | |
| 5,378,435 A | * | 1/1995 | Gavoni | 422/177 |
| 5,722,237 A | * | 3/1998 | Iida et al. | 181/240 |

FOREIGN PATENT DOCUMENTS

| | | |
|---|---|---|
| EP | 0 127 550 | 2/1980 |

* cited by examiner

*Primary Examiner*—Kim Lockett
(74) *Attorney, Agent, or Firm*—Andrus, Sceales, Starke & Sawall, LLP

(57) ABSTRACT

A catalytic muffler includes a housing having an inlet, an outlet, and a plurality of catalyst coated serially stacked perforated cups through which exhaust flows and is acoustically attenuated and catalyzed.

10 Claims, 1 Drawing Sheet

CATALYTIC MUFFLER AND METHOD

BACKGROUND AND SUMMARY OF THE INVENTION

The invention relates to catalytic mufflers.

Catalytic mufflers are known in the art, and perform both a noise baffling muffling function and a catalytic function. The present invention provides a simple and effective catalytic muffler system which may be readily adapted to varying muffling and catalyzing requirements. Acoustic and catalytic properties may be readily varied, including increased baffling of noise and exhaust to surface area time, as well as optimization of catalyst formulation. Customization to particular application needs as well as increased performance are readily accommodated.

DETAILED DESCRIPTION OF THE INVENTION

Figure 1:
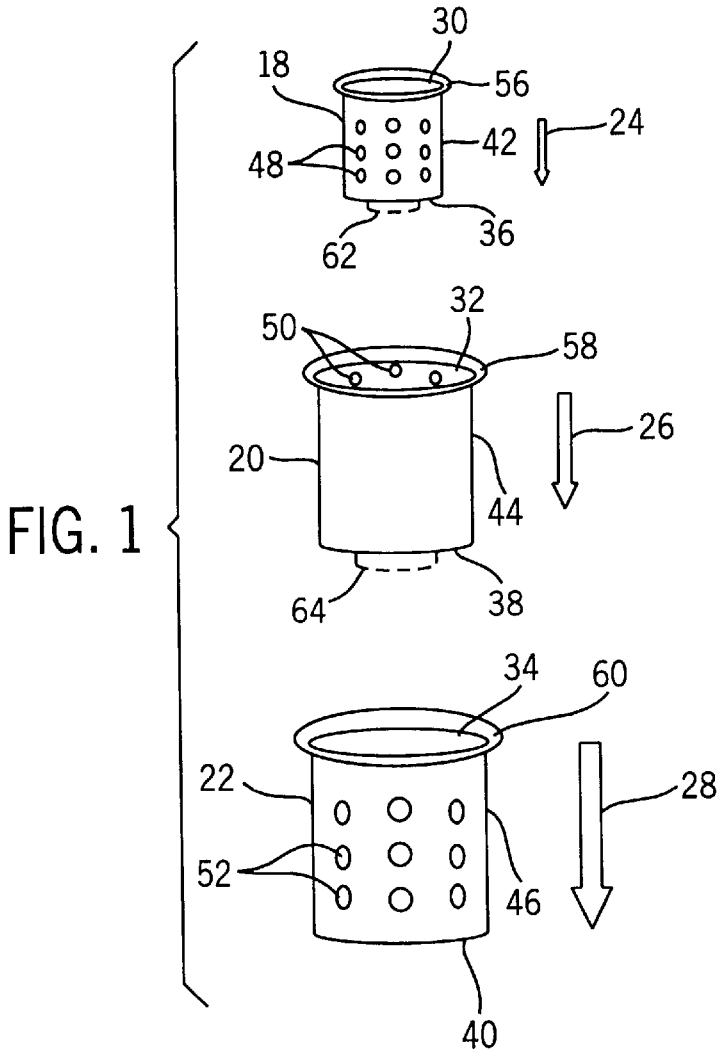
FIG. 1 is a schematic exploded perspective view illustrating construction of a catalytic muffler in accordance with the invention.
Figure 3:
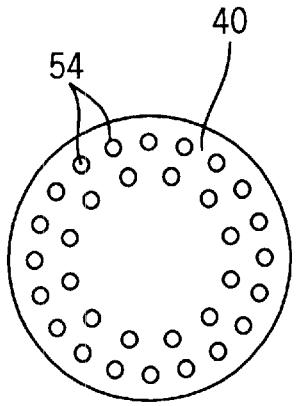
FIG. 3 is an end view of a component of FIG. 1 and shows an alternate embodiment.
Figure 2:
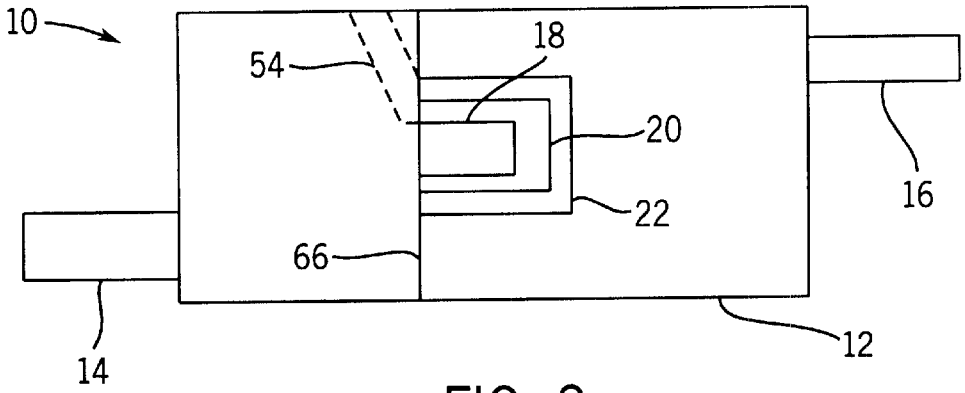
FIG. 2 is a schematic side sectional view of the assembly of FIG. 1 in a housing.

FIGS. 1 and 2 show a catalytic muffler 10 including a housing 12 having an inlet 14, an outlet 16, and a plurality of catalyst-coated perforated cups 18, 20, 22 between inlet 14 and outlet 16. Exhaust flowing through housing 12 from inlet 14 to outlet 16 is acoustically attenuated and catalyzed by the perforated cups 18, 20, 22. The cups are stacked as shown at arrows 24, 26, 28 in serial relation such that exhaust flows serially through the cups, namely through first cup 18, then through second cup 20, then through third cup 22, and so on if additional cups are used. Each cup 18, 20, 22 has an open end 30, 32, 34, respectively, a closed end 36, 38, 40, respectively, and a closed-loop, preferably annular, sidewall 42, 44, 46, respectively, between the respective open end and the respective closed end. Each cup is perforated along a respective perforation pattern 48, 50, 52 through at least one of the respective closed end and respective sidewall. FIG. 1 shows perforation patterns through the sidewalls. FIG. 3 shows a perforation pattern 54 through end wall 40, which end wall perforation pattern may be provided through one or more of the remaining cups instead of or in addition to the perforation pattern through the sidewall.

Cups 18, 20, 22 are stacked in nested relation with closed ends 36, 38, 40 adjacent each other, sidewalls 42, 44, 46 adjacent each other in concentric relation, and open ends 30, 32, 34 adjacent each other. Support structure, to be described, provides a gap between at least one of: (a) closed ends 36, 38, 40; and (b) sidewalls 42, 44, 46. In preferred form, perforation patterns of adjacent cups are non-aligned, to maximize baffling of noise and increase exhaust to surface area time. In the embodiment of FIG. 1, the perforation patterns are through the sidewalls, and the gaps are between the sidewalls of adjacent cups. In the particular embodiment of FIG. 1, first cup 18 is nested into second cup 20 which is nested into third cup 22. Perforation pattern 48 through sidewall 42 of first cup 18 is circumferentially distally opposite perforation pattern 50 through sidewall 44 of second cup 20; and perforation pattern 50 through sidewall 44 of second cup 20 is circumferentially distally opposite perforation pattern 52 through sidewall 46 of third cup 22. In another embodiment, the perforation patterns are through the closed ends, FIG. 3, and the gaps are between the closed ends of adjacent cups. In a further embodiment, perforation patterns are formed through both the sidewalls and the closed ends of the cups, and the gap is formed between both the sidewalls and the closed ends of adjacent cups. In a further embodiment, the muffler includes an air induction duct 54 in housing 12 supplying air to one or more gaps between cups to optimize catalyst formulation.

In one embodiment, the noted support structure is provided by lip flanges 56, 58, 60 at respective open ends 30, 32, 34, which lip flanges engage each other in overlapped relation such that the lip flange 56 of an inner cup such as 18 engages the lip flange such as 58 of an outer cup such as 20 to locate and suspend the inner cup within the outer cup, and such that lip flange 58 engages lip flange 60 of the next outer cup to locate and suspend inner cup 20 within the next outer cup 22, and so on. In another embodiment, raised shoulders such as shown in dashed line at 62, 64 are provided on respective closed ends 36, 38, engaging the closed end of the next cup to locate and space adjacent cups, i.e. raised shoulder 62 engages closed end 38 to locate and space adjacent cups 18 and 20, and raised shoulder 64 engages closed end 40 to locate and space adjacent cups 20 and 22, etc. In another embodiment, the support structure comprises a mounting plate 66 mountingly engaging open ends 30, 32, 34 to mount respective cups 18, 20, 22 in nested relation.

The disclosed system provides a method of muffling and catalyzing exhaust by directing the exhaust through a plurality of catalyst-coated perforated cups 18, 20, 22, etc. The cups are stacked in nested relation, and acoustic properties are varied by varying the perforation pattern of a cup relative to the next cup. The system enables increased baffling of noise and exhaust to surface area time by non-aligning perforation patterns of adjacent cups. The system enables optimizing catalyst formulation by adding induction air between cups.

It is recognized that various equivalents, alternatives and modifications are possible within the scope of the appended claims.

What is claimed is:

1. A catalytic muffler comprising a housing having an inlet, an outlet and a plurality of catalyst-coated perforated cups between said inlet and outlet such that exhaust flowing through said housing from said inlet to said outlet is acoustically attenuated and catalyzed by said cups, wherein said housing extends axially, wherein each cup has an open end, a closed end, and a closed-loop sidewall between said open end and said closed end, each cup being perforated along a perforation pattern through at least one of said closed ends and said sidewall, and wherein said cups are stacked in nested axially overlapped relation with said closed ends adjacent each other, said sidewalls adjacent each other in concentric relation, and said open ends adjacent each other, and comprising support structure providing a gap between at least one of: (a) said closed ends; and (b) said sidewalls.

2. The invention according to claim 1 wherein the perforation patterns of adjacent cups are non-aligned, to maximize baffling of noise and to increase exhaust to surface area time.

3. The invention according to claim 1 wherein said perforation pattern is through said sidewall, and said gap is between sidewalls of adjacent cups.

4. The invention according to claim 2 comprising at least three said cups comprising a first cup nested into a second cup which is nested into a third cup, wherein the perforation pattern through said sidewall of said first cup in circumferentially distally opposite the perforation pattern through said sidewall of said second cup, and wherein the perforation pattern through said sidewall of said second cup is circumferentially distally opposite the perforation pattern through said sidewall of said third cup.

5. The invention according to claim 3 wherein said perforation pattern is through said closed end, and said gap is between closed ends of adjacent cups.

6. The invention according to claim 1 wherein said perforation pattern is through said sidewall and through said closed end, and said gap is between said sidewalls and between said closed ends of adjacent cups.

7. The invention according to claim 1 wherein said muffler includes an air induction duct in said housing supplying air to said gap to optimize catalyst formulation.

8. The invention according to claim 1 wherein said support structure comprises lip flanges at said open ends engaging each other in overlapped relation such that the lip flange of a first of said cups engages the lip flange of a second of said cups to locate and suspend said first cup within said second cup.

9. The invention according to claim 1 wherein said support structure comprises raised shoulders on said closed end engaging the closed end of the next cup to locate and space adjacent cups.

10. The invention according to claim 1 wherein said support structure comprises a mounting plate mountingly engaging said open ends to mount said cups in said nested relation.

* * * * *